US010270197B2

(12) United States Patent
Kitamura et al.

(10) Patent No.: US 10,270,197 B2
(45) Date of Patent: Apr. 23, 2019

(54) FEMALE TERMINAL HAVING A RESILIENTLY DISPLACEABLE CONTACT PIECE FOLDED REARWARD FROM A FRONT END OF A STEP

(71) Applicant: Sumitomo Wiring Systems, Ltd., Yokkaichi, Mie (JP)

(72) Inventors: Keishi Kitamura, Mie (JP); Yoshihiro Mizutani, Mie (JP); Kazuki Mizutani, Mie (JP); Daisuke Hirasawa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/749,175

(22) PCT Filed: Jul. 15, 2016

(86) PCT No.: PCT/JP2016/070941
§ 371 (c)(1),
(2) Date: Jan. 31, 2018

(87) PCT Pub. No.: WO2017/022453
PCT Pub. Date: Feb. 9, 2017

(65) Prior Publication Data

US 2018/0219315 A1 Aug. 2, 2018

(30) Foreign Application Priority Data

Aug. 5, 2015 (JP) ..... 2015-154808

(51) Int. Cl.
*H01R 13/115* (2006.01)
*H01R 13/11* (2006.01)
(Continued)

(52) U.S. Cl.
CPC ..... *H01R 13/115* (2013.01); *H01R 11/22* (2013.01); *H01R 13/11* (2013.01); *H01R 13/113* (2013.01); *H01R 2101/00* (2013.01)

(58) Field of Classification Search
CPC ... H01R 13/115; H01R 13/113; H01R 13/114; H01R 13/055; H01R 13/057;
(Continued)

(56) References Cited

U.S. PATENT DOCUMENTS 6,547,608 B2 * 4/2003 Sato ..... H01R 13/11 439/851
8,616,924 B2 * 12/2013 Ishida ..... H01R 13/113 439/851
(Continued)

FOREIGN PATENT DOCUMENTS

| | | |
|---|---|---|
| JP | 1-168970 | 11/1989 |
| JP | 2006-236899 | 9/2006 |
| JP | 2006-253075 | 9/2006 |

*Primary Examiner* — Harshad C Patel
(74) *Attorney, Agent, or Firm* — Gerald E. Hespos; Michael J. Porco; Matthew T. Hespos

(57) ABSTRACT

A female terminal disclosed by this specification is a female terminal (10) to which a male terminal (50) is connected from front, and includes a bottom plate (15) long in a front-rear direction, a ceiling plate (16) disposed to face the bottom plate (15), a pair of side plates (17) linking both side edges of the bottom plate (15) and both side edges of the ceiling plate (16), a step portion (25) provided on a front end edge of the bottom plate (15) in a stepwise manner to be slightly higher than the bottom plate (15) and extending forward to be disposed between the pair of side plates (17), and a resilient contact piece (30) resiliently displaceably provided by being folded rearwardly from a front end edge of the step portion (25), the male terminal (50) being capable of resiliently contacting the resilient contact piece (30) from front.

5 Claims, 5 Drawing Sheets

(51) Int. Cl.
*H01R 11/22* (2006.01)
*H01R 101/00* (2006.01)

(58) Field of Classification Search
CPC ..... H01R 13/185; H01R 13/11; H01R 11/22; H01R 13/10
USPC ..... 439/852, 851, 849, 850, 854, 859, 884, 439/351, 352
See application file for complete search history.

(56) References Cited

U.S. PATENT DOCUMENTS

| | | | | |
|---|---|---|---|---|
| 9,431,723 | B2 * | 8/2016 | Chikusa | H01R 4/48 |
| 9,601,855 | B2 * | 3/2017 | Kashiwada | H01R 13/115 |
| 9,748,685 | B2 * | 8/2017 | Oba | H01R 4/023 |
| 2012/0034827 | A1 | 2/2012 | Ishikawa et al. | |
| 2013/0109250 | A1 * | 5/2013 | Haga | H01R 13/03 439/816 |
| 2013/0288545 | A1 * | 10/2013 | Amano | H01R 13/113 439/817 |
| 2013/0288547 | A1 * | 10/2013 | Amano | H01R 13/113 439/852 |
| 2013/0288548 | A1 * | 10/2013 | Amano | H01R 13/113 439/852 |
| 2016/0006143 | A1 * | 1/2016 | Chikusa | H01R 4/48 439/816 |

* cited by examiner

FEMALE TERMINAL HAVING A RESILIENTLY DISPLACEABLE CONTACT PIECE FOLDED REARWARD FROM A FRONT END OF A STEP

BACKGROUND

Field of the Invention

This specification relates to a female terminal.

Description of the Related Art

Japanese Unexamined Patent Publication No. 2006-236899 discloses a female terminal including a rectangular tubular terminal fitting portion into which a male terminal is inserted. The terminal fitting portion includes a bottom plate, two side plates rising from both sides of the bottom plate and a resilient contact piece disposed between the side plates while being folded rearwardly from the tip edge of the bottom plate. The female terminal is connected electrically to the male terminal by the contact of the male terminal and the resilient contact piece when the male terminal is inserted into the terminal fitting portion.

Slits are provided in lower end parts of the side plates in the above-described female terminal to fold the resilient contact piece rearwardly from the tip of the bottom plate. Thus, a tip part of the resilient contact piece is exposed from lower end parts of a pair of outer walls, and an external force applied to a lower part of the tip of the terminal may possibly deform and damage the resilient contact piece.

The female terminal disclosed in this specification prevents damage to the resilient contact piece.

SUMMARY

This specification is directed to a female terminal to which a male terminal is connected from the front. The female terminal includes a bottom plate that is long in a front-rear direction and a ceiling plate that is disposed to face the bottom plate. Two opposed side plates link sides of the bottom plate and sides of the ceiling plate. A step is provided on a front end edge of the bottom plate in a stepwise manner to be raised toward the ceiling plate from the bottom plate. The step extends forward to be disposed between the side plates. A resilient contact piece is folded rearward from a front end edge of the step and is resiliently displaceable. The male terminal is capable of resiliently contacting the resilient contact piece from the front.

According to the terminal thus configured, the step is provided with the resilient contact piece and is formed in the stepwise manner to be raised toward the ceiling plate from the bottom plate at a position between the side plates. Thus, an external force that is applied to a lower part of the front end of the terminal is not applied to the resilient contact piece. In this way, the deformation and damage of the resilient contact piece can be suppressed.

The step may be formed along edges of the side plates at the bottom plate. According to this configuration, a large space can be ensured between the step and the ceiling plate while preventing the step from being exposed from the side plates, for example, as compared to a step extending obliquely forward toward the ceiling plate. In this way, the male terminal and the step will not butt against each other when the male terminal is inserted between the step and the ceiling plate.

An end edge of the step on the side of the bottom plate may be inclined obliquely to be closer to the ceiling plate than front end positions of the side edges at the bottom plate. According to this configuration, the inclined portion is disposed closer to the ceiling plate than a virtual connection line connecting the front end edge of the bottom plate and the front end positions of the side edges at the bottom plate. Thus, it can be suppressed that an external force is applied to the inclined portion, which is the end edge part of the step on the side of the bottom plate.

According to the female terminal disclosed by this specification, it is possible to prevent the damage of a resilient contact piece.

DETAILED DESCRIPTION

One embodiment of the technique disclosed by this specification is described with reference to FIGS. 1 to 5.

A female terminal 10 connectable to a male terminal 50 that includes a tab-shaped male connecting portion 51 is illustrated in FIGS. 1 to 5. Note that, in the following description, a vertical direction is based on that in FIGS. 2 and 3. Further, a front-rear direction is based on a lateral direction in FIGS. 2 and 3 and sides of the male terminal 50 and the female terminal 10 to be connected to each other are referred to as front sides.

Figure 1:
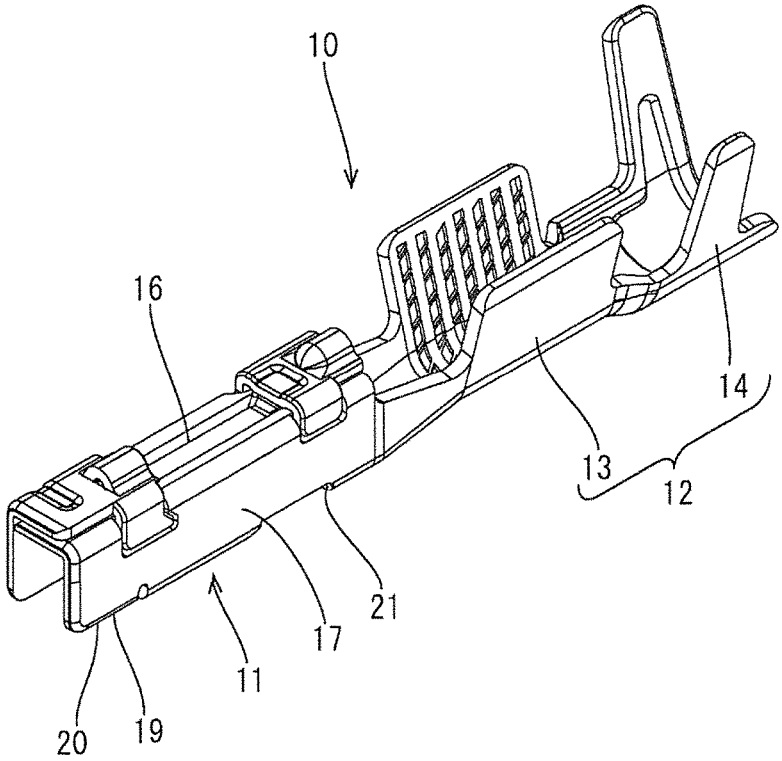
FIG. 1 is a perspective view of a female terminal.
Figure 2:
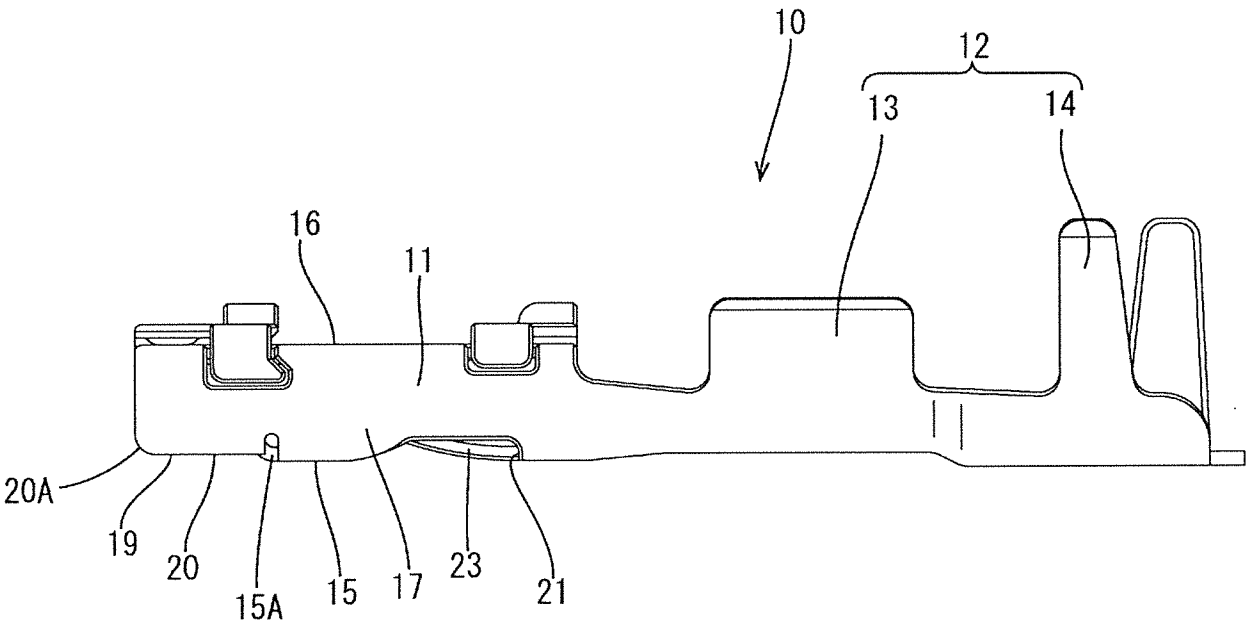
FIG. 2 is a side view of the female terminal.

As shown in FIGS. 1 and 2, the female terminal 10 includes a connecting tube 11 in the form of a rectangular tube into which the male connecting portion 51 of the male terminal 50 is inserted from the front, and a wire fixing portion 12 to be fixed to an end of an unillustrated wire. The wire fixing portion 12, as shown in FIG. 1, has a wire barrel 13 and an insulation barrel 13 are connected in the front-rear direction. The wire barrel 13 is to be crimped to a core exposed from an insulation coating at the end of the wire and the insulation barrel 14 is to be crimped to the insulation coating. The female terminal 10 and the wire are electrically connected by crimping the wire barrel 13 to the core.

Figure 3:
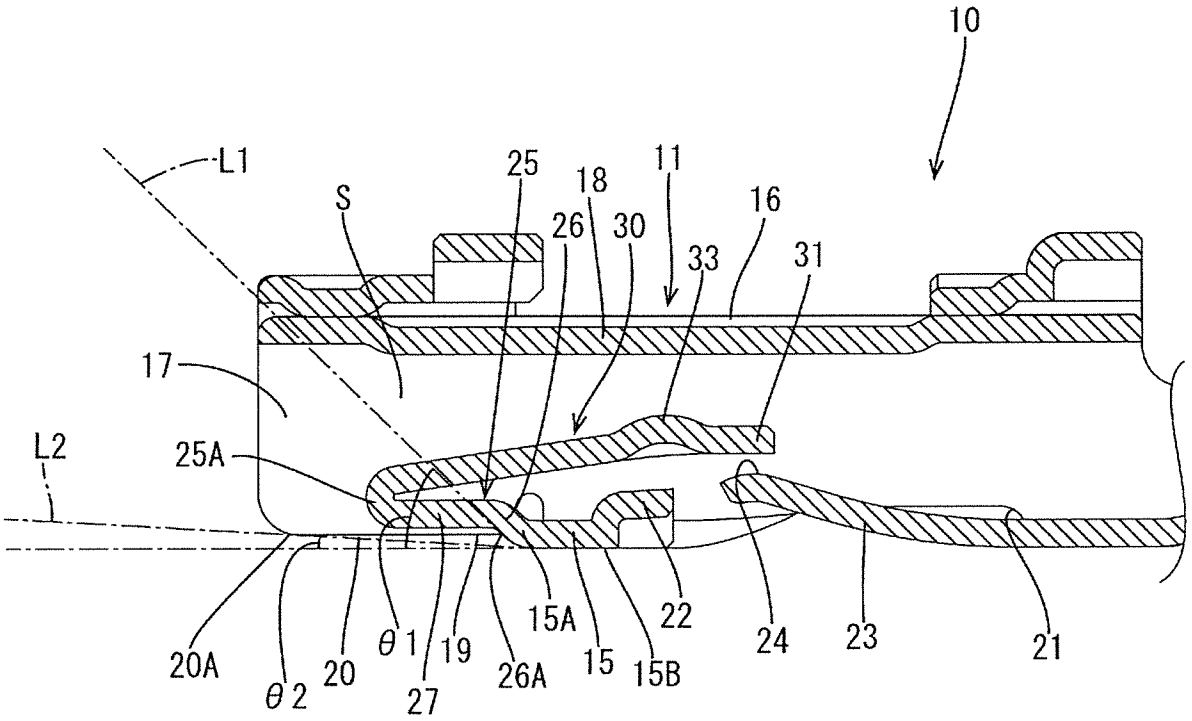
FIG. 3 is an enlarged section of an essential part of the female terminal.
Figure 4:
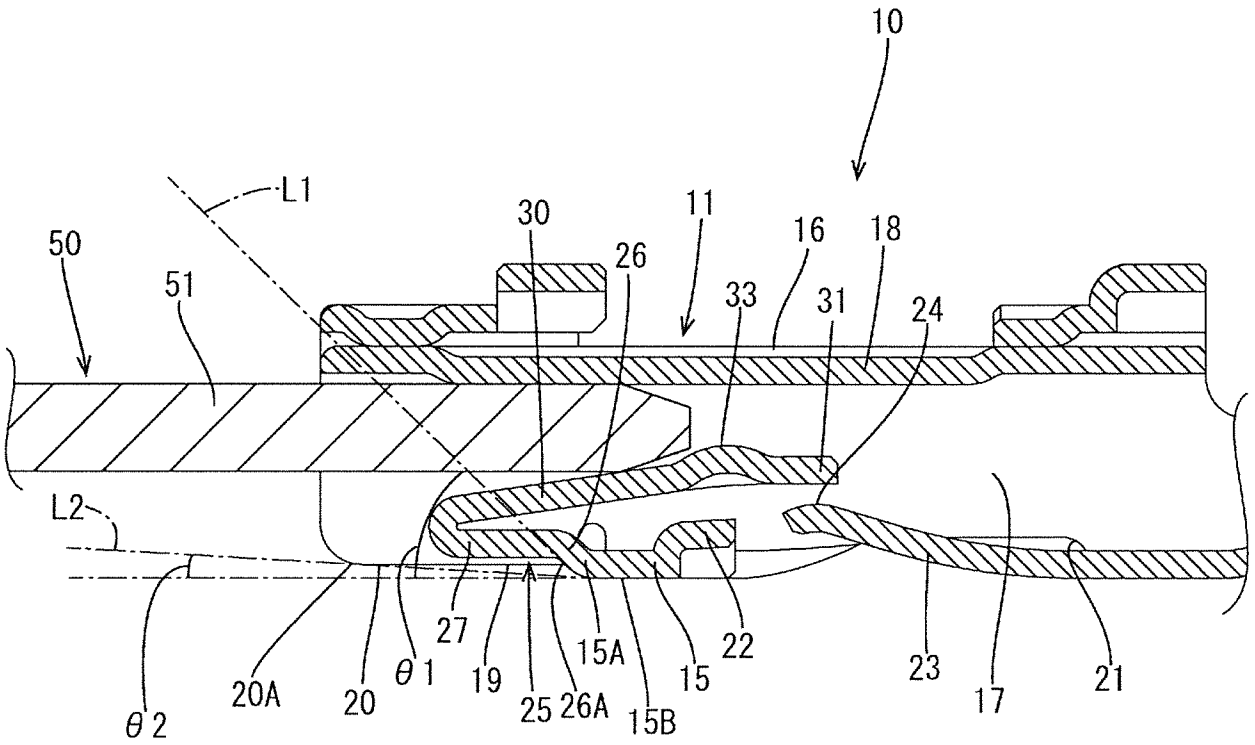
FIG. 4 is a section, corresponding to FIG. 3, showing a state where a male terminal is shallowly inserted in a connecting tube portion.
Figure 5:
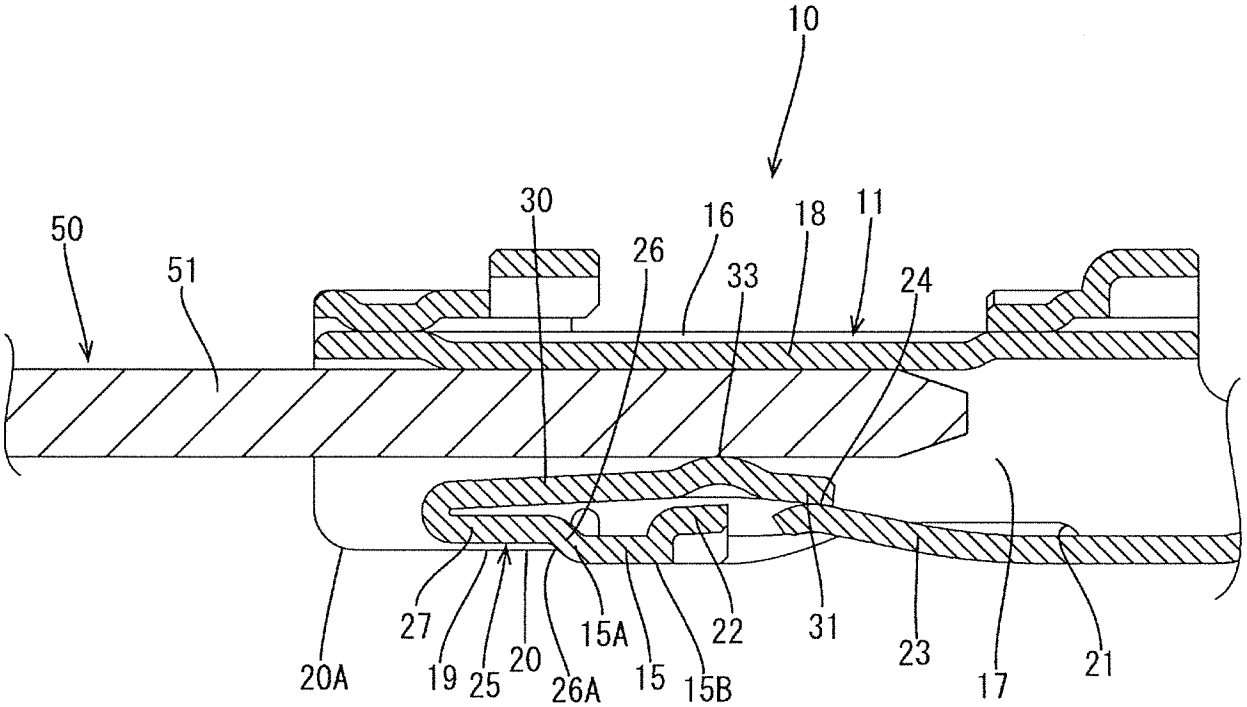
FIG. 5 is a section, corresponding to FIG. 3, showing a state where the male terminal is at a proper insertion position in the connecting tube portion.

The connecting tube 11 is formed to be connected in front of the wire fixing portion 12, as shown in FIGS. 1 and 2, and includes a bottom plate 15 that is long in the front-rear direction, a ceiling plate 16 disposed to vertically face the bottom plate 15 and two side plates 17 linking both sides of the bottom plate 15 and both sides of the ceiling plate 16 in the vertical direction, as shown in FIGS. 3 to 5. The ceiling plate 16 is long in the front-rear direction and a rib-like pressing portion 18 extends in the front-rear direction to project in a substantially central part of the inner surface of the ceiling plate 16.

As shown in FIG. 2, the side plates 17 are substantially rectangular in a side view and face each other in the lateral direction. As shown in FIGS. 2 to 5, a slit 19 is formed between a lower part of the front end of each side plate 17 and the bottom plate 15 and extends straight rearward from the front end of the side plate 17. Thus, each side plate 17 has a bottom side edge 20 near a front end part of each side plate 17 and extending straight in the front-rear direction at a position slightly higher than the lower edge of a central part of the side plate 17 in the front-rear direction.

As shown in FIGS. 3 to 5, the bottom plate 15 is slightly shorter in the front-rear direction than the ceiling plate 16 and the side plates 17, and the front end position of the bottom plate 15 is slightly forward of the rear edges of the slits 19 formed from the bottom plate 15 to the side plates 17, and slightly behind the front end position of the pressing portion 18 on the ceiling plate 16.

A substantially rectangular through hole 21 is formed at a position of the bottom plate 15 slightly behind a central part of the bottom plate 15 in the front-rear direction and penetrates through the bottom plate 15 in the vertical direction, which is a plate thickness direction. A projection 22 is formed on the front edge of the through hole 21 and projects up, i.e. toward the ceiling plate 16. This projection 22 is arranged to vertically face a substantially central part of the pressing portion 18 in the front-rear direction on the ceiling plate 16.

Further, a spring piece 23 is cantilevered obliquely up and forward from the rear edge of the through hole 21 and is resiliently deformable down with the rear edge of the through hole 21 serving as a support. A front part of the spring piece 23 serves as a biasing portion 24 is bent slightly down to form a rounded upper surface. This biasing portion 24 is disposed above the projection 22 in a natural state where the spring piece 23 is not resiliently deformed.

As shown in FIGS. 3 to 5, a step 25 is formed on a front part 15A of the bottom plate 15 and extends forward between the side plates 17. The step 25 is raised slightly up toward the ceiling plate 16 from the bottom plate 15.

As shown in FIGS. 3 and 4, the step 25 includes an inclined portion 26 extending slightly obliquely toward a front-upper side from the front 15A of the bottom plate 15 and a flat portion 27 extending straight forward from the upper end of the inclined portion 26. In other words, an end part of the step 25 on the side of the bottom plate 15 serves as the inclined portion 26 extending slightly obliquely toward the front-upper side.

The inclined portion 26 extends farther up than front end positions 20A of the bottom side edges 20 such that an angle θ1 between a first virtual straight line L1 connecting a lower surface 26A of the inclined portion 26 and the front 15A of the bottom plate 15 and a lower surface 15B of the bottom plate 15 is larger than an angle θ2 between a second virtual straight line L2 connecting the front end positions 20A of the bottom side edges 20 of the side plates 17 and the front edge 15A of the bottom plate 15 and the lower surface 15B of the bottom plate 15. Thus, the inclined portion 26 is disposed above the second virtual straight line L2 and an upper end part of the inclined portion 26 is disposed between the side plates 17.

As shown in FIGS. 3 to 5, the flat portion 27 extends straight forward along the bottom side edges 20 of the side plates 17 from the upper end of the inclined portion 26 and extends up to substantially central parts of the bottom side edges 20 in the front-rear direction. Further, the flat portion 27 is disposed slightly above the bottom side edges 20 of the side plates 17. Thus, as shown in FIG. 3, the flat portion 27 is completely covered together with the upper edge of the inclined portion 26 from both sides by the side plates 17, but a large space S between the flat portion 27 and the ceiling plate 16 is ensured.

Further, as shown in FIGS. 3 and 4, a resilient contact piece 30 folded rearward from the front end of the step 25. This resilient contact piece 30 is resiliently displaceable down with a front edge 25A of the step 25 as a supporting point. The resilient contact piece 30 extends straight obliquely toward an upper-rear side from the front 25A of the step 25, and a rear end part 31 of the resilient contact piece 30 is disposed slightly above the biasing portion 24 in the spring piece 23.

Accordingly, the resilient contact piece 30 is formed to extend from substantially central parts of the bottom side edges 20 of the side plates 17 in the front-rear direction to a substantially central part of the connecting tube 11 in the front-rear direction while being gently inclined and to be long in the front-rear direction. When the resilient contact piece 30 is displaced resiliently down, the rear end part 31 of the resilient contact piece 30 contacts the biasing portion 24 of the spring piece 23 from above. Further, when the male connecting portion 51 of the male terminal 50 is inserted into the connecting tube 11, the resilient contact piece 30 can resiliently contact the male connecting portion 51. When the resilient contact piece 30 is pressed down by the male connecting portion 51 and the rear end part 31 of the resilient contact piece 30 contacts the biasing portion 24 of the spring piece 23 from above, the resilient contact piece 30 is biased from below by the spring piece 23, as shown in FIG. 5. Thus, a contact load of the resilient contact piece 30 on the male connecting portion 51 is high.

Further, a contact point portion 33 protruding up is provided on the rear end part 31 of the resilient contact piece 30 and disposed above the projecting portion 22 of the bottom plate 15.

Accordingly, in the process of inserting the male connecting portion 51 of the male terminal 50 into the connecting tube 11, a tip part of the male connecting portion 51 first contacts the substantially central part of the resilient contact piece 30 in the front-rear direction as shown in FIG. 4. If the male connecting portion 51 is inserted farther, the contact point 33 is pressed down by the male connecting portion 51 and the resilient contact piece 30 biases the male connecting portion 51 up while being displaced resiliently down with the front edge 25A of the step 25 serving as a support. In this way, the male connecting portion 51 is sandwiched by the pressing portion 18 of the ceiling plate 16 and the contact point portion 33 of the resilient contact piece 30.

When the male connecting portion 51 reaches the proper insertion position in the connecting tube 11, as shown in FIG. 5, the rear end part 31 of the resilient contact piece 30 contacts the biasing portion 24 of the spring piece 23 and the resilient contact piece 30 is biased down by the spring piece 23. In this way, the male connecting portion 51 is sandwiched at a proper load by the pressing portion 18 of the ceiling plate 16 and the contact point 33 of the resilient contact piece 30 and the male terminal 50 and the female terminal 10 are connected electrically. Note that if an excessive force is applied to the resilient contact piece 30, such as due to the prizing of the male connecting portion 51, the lower surface of the contact point 33 on the resilient contact piece 30 comes into contact with the projecting portion 22 of the bottom plate 15, thereby preventing an excessive resilient displacement of the resilient contact piece 30.

This embodiment is configured as described above. Next, functions and effects of the female terminal 10 are described.

According to the female terminal 10 of this embodiment, the step 25 slightly higher than the bottom plate 15 is formed on the front edge 15A of the bottom plate 15 to be disposed between the two side plates 17, and the resilient contact piece 30 folded rearward is formed on the front 25A of the step 25. That is, even if an external force is applied to a lower part of the front end of the connecting tube 11 such as due to the drop of the female terminal 10, the resilient contact piece 30 will not be deformed by the external force.

Further, according to this embodiment, the inclined portion 26 of the step 25 extends up from the front edge 15A of the bottom plate 15 so as to be disposed above the second virtual straight line L2 connecting the front end positions 20A of the bottom side edges 20 of the side plates 17 and the front 15A of the bottom plate 15, and the flat portion 27 provided on the front edge of the inclined portion 26 is completely covered from both sides by the two side plates 17. Thus, the application of an external force to a base end part of the step 25 can be alleviated, for example, even if the lower part of the front end of the connecting tube 11 contacts a horizontal surface.

It is also considered to prevent the damage of the resilient contact piece due to an external force applied to the lower end part of the front end of the connecting tube, for example, by forming a long inclined portion and forming the resilient contact piece on the upper end edge of the inclined portion without forming any flat portion in the step portion or by forming the resilient contact piece folded rearward from the front of the bottom plate.

However, if the inclined portion is long, a space between the step and the ceiling plate becomes narrow. Thus, when the male connecting portion is inserted into the connecting tube, the step and the male connecting portion butt against each other in the front-rear direction and connection reliability between the male connecting portion and the resilient contact piece may be reduced due to the damage of the step.

Further, if the resilient contact piece is formed by being folded rearwardly from the front of the bottom plate, an angle of inclination of the resilient contact piece becomes larger, the male connecting portion butts against the resilient contact piece and insertion resistance of the male connecting portion increases.

However, according to this embodiment, a length of the inclined portion 26 of the step 25 is set to be short and the flat portion 27 of the step 25 is disposed slightly above the bottom side edges 20 on the two side plates 17 to extend along the bottom side edges 20, as shown in FIG. 3. Thus, the space S between the step 25 and the ceiling plate 16 can be large. In this way, the step 25 and the male connecting portion 51 will not butt against each other in the front-rear direction.

Further, since the resilient contact piece 30 is long in the front-rear direction and inclined at a gentle angle by forming the forward extending step 25 on the front edge 15A of the bottom plate 15. Thus, the male connecting portion 51 can be brought smoothly into contact with the resilient contact piece 30. In this way, an increase in the insertion resistance of the male connecting portion 51 can be suppressed.

The specification is not limited to the above described and illustrated embodiment. For example, the following various modes are also included.

In the above embodiment, the flat portion 27 extends forward. However, there is no limitation to this and the flat portion may extend obliquely to a front-upper or front-lower side if the flat portion is disposed between the pair of side plates.

In the above embodiment, the resilient contact piece 30 is biased by the spring piece 23. However, there is no limitation to this and the resilient contact piece may not be biased by the spring piece.

LIST OF REFERENCE SIGNS

10: female terminal
15: bottom plate
16: ceiling plate
17: side plate
20: bottom-plate-side side edge
25: step
26: inclined portion
30: resilient contact piece
50: male terminal

The invention claimed is:

1. A female terminal having opposite front and rear ends and to which a male terminal is connected from the front end, comprising:

a bottom plate long in a front-rear direction;

a ceiling plate disposed to face the bottom plate;

two opposed side plates linking both sides of the bottom plate and both sides of the ceiling plate;

a step provided on a front end of the bottom plate in a stepwise manner to be raised toward the ceiling plate from the bottom plate, the step extending forward to be disposed between the side plates, the step including an inclined portion sloping up toward the ceiling plate and toward the front end of the female terminal and a flat portion extending from an upper end of the inclined portion toward the front end of the female terminal; and a resilient contact piece resiliently displaceably provided by being folded rearwardly from a front end of the flat portion of the step, the male terminal being capable of resiliently contacting the resilient contact piece from the front, wherein:

the front end of the flat portion of the step is arranged behind front end positions of the side plates;

bottom side edges of front end parts of the side plates are slightly higher toward the ceiling plate than the bottom plate; and the step higher toward the ceiling plate than the bottom side edges of the front end parts of the side plates.

2. The female terminal of claim 1, wherein the inclined portion is set such that an angle between a plane defined by the inclined portion and a plane defined by the bottom plate is larger than an angle between the plane defined by the bottom plate and a virtual connection line connecting front ends of the bottom side edges of the side plates.

3. The female terminal of claim 1, further comprising a projection projecting up and rearward on the bottom wall at a position opposed to an area on the resilient contact piece that is contacted by the male terminal.

4. A female terminal having opposite front and rear ends and to which a male terminal is connected from front, comprising:

a bottom plate long in a front-rear direction;

a ceiling plate disposed to face the bottom plate;

two opposed side plates linking both side edges of the bottom plate and both side edges of the ceiling plate;

a step provided on a front end of the bottom plate in a stepwise manner to be raised toward the ceiling plate from the bottom plate, the step extending forward to be disposed between the side plates; and a resilient contact piece resiliently displaceably provided by being folded rearwardly from a front end of the step, the male terminal being capable of resiliently contacting the resilient contact piece from the front, wherein:

the front end of the step is arranged behind front end positions of the side plates;

bottom side edges of front end parts of the side plates are higher toward the ceiling plate than the bottom plate;

the step includes an inclined portion extending obliquely forward toward the front end of the female terminal and toward the ceiling plate from a front end of the bottom plate; and the inclined portion is set such that an angle between a plane defined by the inclined portion and of a plane defined by the bottom plate is larger than an angle between the plane defined by the bottom plate and a virtual connection line connecting plane defined by the bottom plate and front ends of the bottom side edges of the side plates.

5. The female terminal of claim 4, further comprising a projection projecting up and rearward on the bottom wall at a position opposed to an area on the resilient contact piece that is contacted by the male terminal.

* * * * *